US005421467A

United States Patent [19]

Dittborn

[11] Patent Number: 5,421,467

[45] Date of Patent: Jun. 6, 1995

[54] ADJUSTABLE MODULAR SHELVING SYSTEM

[75] Inventor: Alberto Dittborn, Santiago, Chile

[73] Assignee: Napa Valley Box Company, San Diego, Calif.

[21] Appl. No.: 303,451

[22] Filed: Sep. 9, 1994

Related U.S. Application Data

[63] Continuation of Ser. No. 19,623, Mar. 4, 1994.

[51] Int. Cl.[6] ..... A47F 5/00

[52] U.S. Cl. ..... 211/150; 211/42; 211/188; 108/6; 248/242

[58] Field of Search ..... 211/150, 188, 194, 42, 211/43, 36, 37; 108/6, 111; 248/242

[56] References Cited

U.S. PATENT DOCUMENTS

| | | | |
|---|---|---|---|
| D. 337,673 | 7/1993 | Goetz . | |
| 1,620,313 | 3/1927 | Abele . | |
| 1,700,976 | 2/1929 | Bulman . | |
| 3,217,671 | 11/1965 | Walsh . | |
| 3,387,713 | 6/1968 | Brooks . | |
| 3,464,565 | 9/1969 | Nevai | 211/42 |
| 3,492,057 | 1/1970 | Watson | 211/42 X |
| 3,497,073 | 2/1970 | Bartell | 211/150 X |
| 3,700,114 | 10/1972 | Myers . | |
| 4,200,195 | 4/1980 | Hager . | |
| 4,688,681 | 8/1987 | Bergeron | 211/36 |

*Primary Examiner*—Robert W. Gibson, Jr.
*Attorney, Agent, or Firm*—Foley & Lardner

[57] ABSTRACT

A shelving system includes first and second support members extending in parallel vertical planes, and a pair of shelves mounted intermediate the support members. Each of the shelves has a longitudinal pivot axis perpendicular to the planes of the support members. Each shelf is continuously positionable at any angular orientation about its pivot axis. Each of the support members includes an upper and a lower stacking surface. Modular units may be stacked to form a larger shelving system wherein mating upper and lower stacking surfaces abut. To facilitate alignment when stacked, the stacking surfaces include first and second alignment portions, and upper and lower alignment cavities formed in each support member. To maintain alignment of the units, an alignment member is received in mutually facing alignment cavities in the assembled shelving system.

20 Claims, 4 Drawing Sheets

ADJUSTABLE MODULAR SHELVING SYSTEM

CROSS-REFERENCES TO RELATED APPLICATIONS

This is a continuation application pursuant to 37 CFR 1.53(b) of copending U.S. patent application Ser. No. 29/019,623, filed Mar. 4, 1994.

BACKGROUND OF THE INVENTION

1. Field of the Invention

The present invention relates generally to an adjustable modular shelving system and, more particularly, to a shelving system in which at each shelving level a pair of shelves is mounted pivotally between support members so that the shelves may pivot continuously, facilitating adjustment and permitting the system to hold a variety of differently configured items in a range of positions.

2. Description of Related Art

A great number of shelving arrangements exist in which one or more shelves are arranged for holding and storing an array of items. Most known shelving systems include only flat, horizontal shelves arranged between upright side panels. Some known shelving arrangements offer angled shelves, usually having an L-shaped or V-shaped cross section, that are particularly convenient for storing certain items, such as books, compact discs, footballs, soccer balls and the like. Examples of such shelving systems are described in U.S. Pat. No. 1,620,313 issued on Mar. 8, 1927 to Abele, and U.S. Des. Pat. No. 337,673 issued on Jul. 27, 1993 to Goetz.

Many known shelving arrangements offer some degree of adjustability, particularly in the height of individual shelves and in the spacing between shelves. However, few shelving systems offer adjustability in the configuration of the shelves themselves, such as between a flat, horizontal configuration and an L-shaped or V-shaped configuration. Known shelving systems offering adjustability of shelf configuration generally permit movement of the shelves, or portions of the shelves, between discrete positions, such as an inactive raised position and a storage position, or between discrete storage positions. Examples of such arrangements are described in U.S. Pat. No. 1,700,976 issued to Bulman on Feb. 5, 1929, U.S. Pat. No. 3,700,114 issued to Myers on Oct. 24, 1972, and U.S. Pat. No. 4,200,195 issued to Hager on Apr. 29, 1980. However, prior art shelving systems do not afford continuous (i.e. non-discrete) adjustment of the configuration of the shelves. While shelves may pass through a variety of angular configurations, they are generally incapable of assuming stable angular arrangements other than in the discrete stable positions provided. Moreover, to permit adjustability of the shelves in such systems, a rigid framework including lateral upright supports and cross bracing between the supports is generally required, adding to the cost and weight of the system.

Thus, it would be desirable to provide a shelving system that permits continuous angular adjustment of the configuration of the shelves, such as between a flat, horizontal plane and any L-shaped or V-shaped cross section. Furthermore, the cost and ease of manufacturing of such a shelving system would be greatly enhanced by allowing the shelves to cooperate with lateral upright supports to establish a stable structure, thereby eliminating the need for additional cross bracing between the supports. Finally, such a shelving system becomes even more versatile if it can be reduced to modular units that could be used alone, or stacked to provide additional storage space.

The present invention is directed to a stable, yet versatile, adjustable modular shelving system that responds to these needs, while at the same time providing an attractive and inexpensive alternative to existing shelving systems.

SUMMARY OF THE INVENTION

The present invention features a shelving unit wherein each shelf may be pivoted about a longitudinal pivot axis and continuously positioned at any angular orientation with respect to the pivot axis. The present invention also features a shelving system including two or more such modular shelving units particularly configured to facilitate stacking and alignment of one shelving unit atop another.

In accordance with one aspect of the invention, there is provided a shelving unit that includes a pair of upright support members extending in parallel planes, and a pair of shelves mounted intermediate the support members. Each of the shelves has a longitudinal pivot axis oriented perpendicularly to the planes of the support members, the pivot axes lying in a common plane. Each of the shelves may be continuously positioned at any angular orientation about its respective pivot axis. The system also includes a plurality of connecting members, a pair of the connecting members being associated with each of the shelves to mount the shelves pivotally on the support members.

In accordance with another aspect of the invention, a modular shelving unit is provided that, in addition to continuously positionable shelves, includes stacking surfaces on the upper and lower ends of each of the upright support members, thereby permitting similar modular units to be stacked one on top of another.

In accordance with a further aspect of the invention, there is provided a modular shelving system that includes lower and upper modular shelving units, the upper modular shelving unit being disposed atop the lower unit. Stacking surfaces on the respective shelving units conformingly engage to align and support the upper shelving unit on the lower shelving unit. The shelves of each unit are continuously pivotable about a respective pivot axis.

BRIEF DESCRIPTION OF THE DRAWINGS

The present invention will become more fully understood from the following detailed description, taken in conjunction with the accompanying drawings, wherein like reference numerals refer to like parts, in which.

DESCRIPTION OF THE PREFERRED EMBODIMENTS

Before beginning the detailed description of the FIGURES and the preferred embodiments shown therein, several general comments will assist in understanding the scope of the invention.

The most preferred and illustrated embodiments include shelving units having two or more pairs of shelves mounted between two parallel upright sides or support members. However, the invention is broad enough in scope to cover shelving systems having only a single set of shelves, or more than two upright sides (i.e. including an intermediate support between two outer sides). Moreover, while the preferred material for the sides and shelves of the shelving system is wood, other materials such as plastics or metal may be employed and would be within the scope of the invention.

Figure 1:
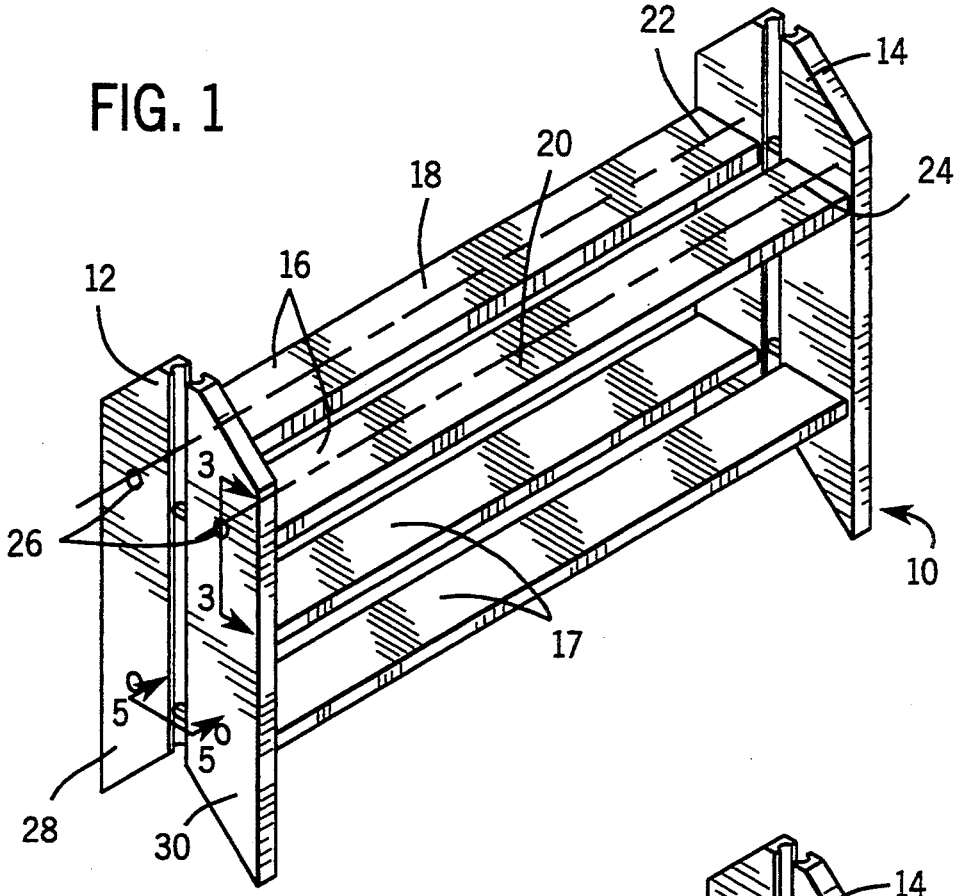
FIG. 1 is a top perspective view of a shelving unit in accordance with the invention wherein the shelves of the unit are oriented in a generally horizontal plane.

Turning now to the drawings and referring to FIG. 1, a shelving unit 10 includes a first support member or side 12 extending in a substantially vertical plane, and a second support member or side 14 extending in a plane parallel to first side 12. A set of shelves 16 extends between first side 12 and second side 14. Additional sets of shelves 17 may be included between first side 12 and second side 14 as illustrated in FIG. 1.

Each set of shelves 16 includes a first shelf 18 and a second shelf 20 mounted on sides 12 and 14, and pivotal about respective pivotal axes 22, 24. Connecting members 26 serve to hold each shelf 18, 20 in place between sides 12, 14 and permit pivotal movement of each shelf 18, 20 about its respective pivot axis 22, 24. In each set 16 of shelves 18, 20, pivotal axes 22, 24 lie in a common plane. Where pivotal axes 22, 24 of each set 16 of shelves 18, 20 lie in a common horizontal plane, as shown in FIG. 1, shelves 18, 20 may be positioned horizontally to establish a flat, horizontal storage surface on which various articles (not shown) may be placed.

As illustrated in FIG. 1, each side 12, 14 is assembled from two identical panels 28, 30 arranged in mutually facing relation and joined as will be described below. The use of identical panels 28, 30 offers the advantage of reducing manufacturing costs by permitting the production of interchangeable elements that may be easily assembled without regard to their specific position in shelving unit 10. Moreover, once mounted between sides 12 and 14, shelf set 16 preferably establishes with sides 12, 14, a stable, self-supporting unit requiring no additional cross bracing for support.

Figure 2:
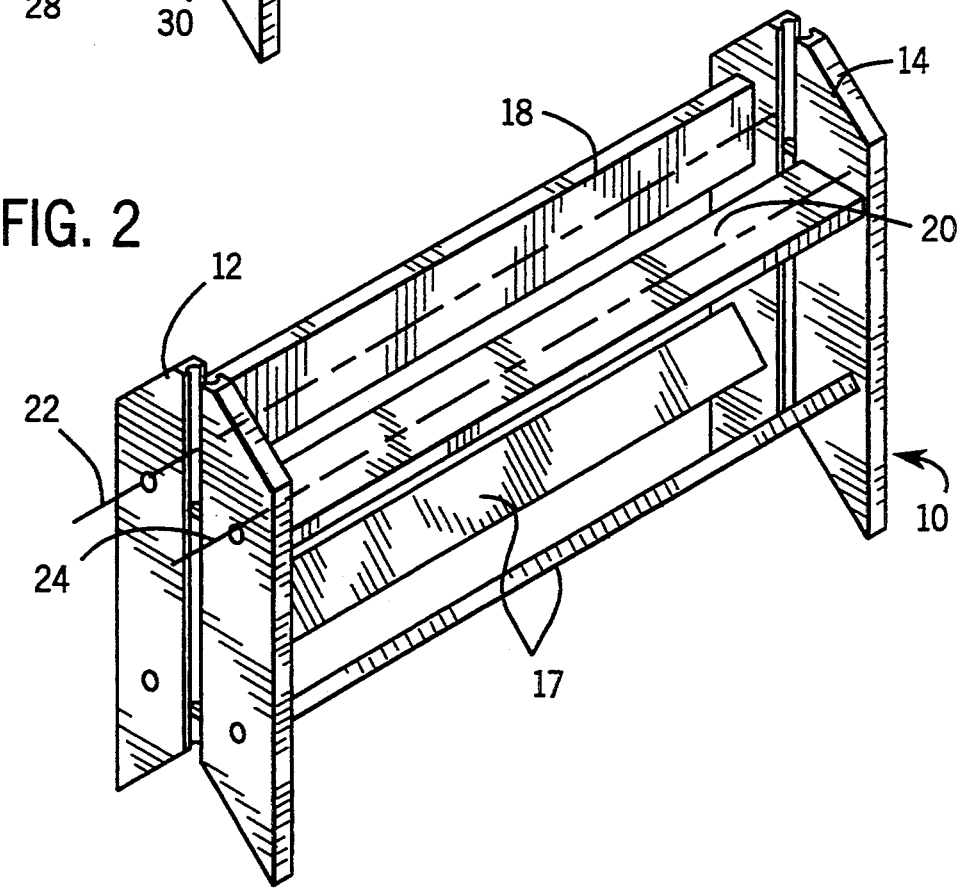
FIG. 2 is a top perspective view of the shelving unit shown in FIG. 1, illustrating certain angular orientations into which the shelves may be positioned.

As illustrated in FIG. 2, each shelf 18, 20 in assembled shelving unit 10 is continuously pivotable about its respective pivot axis 22, 24, and may be positioned at any angular orientation with respect thereto. Hence, where large, flat objects, such as books, are to be placed in shelving unit 10, shelves 18, 20 may be positioned in a generally horizontal orientation as shown in FIG. 1. Alternatively, as illustrated in FIG. 2, one shelf 20 in a set 16 may be positioned horizontally for holding an object, while the other shelf 18 in the set may be rotated perpendicularly to serve as a back or stop. Furthermore, the shelves in other shelving sets 17 may be positioned angularly with respect to one another, such as for stacking books or compact discs at an inclined angle with one side supported by each shelf in the set. This feature of shelving unit 10 facilitates storage of rounded objects, such as sports balls, that are more effectively held on angled shelves than on flat shelves.

Figure 3:
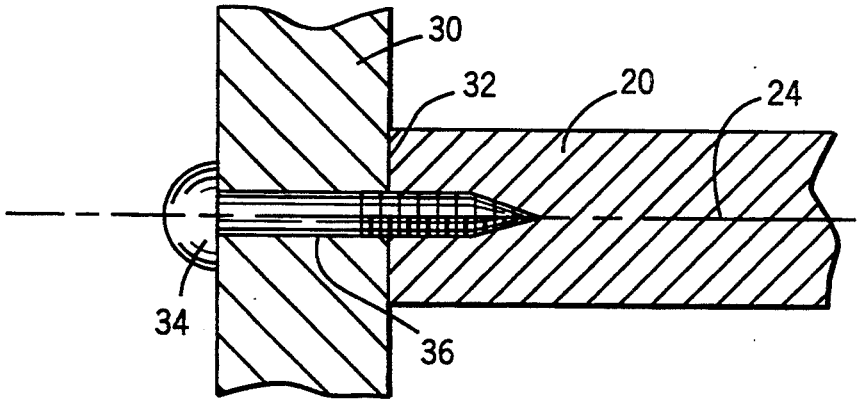
FIG. 3 is a partial sectional view along section 3—3 in FIG. 1 illustrating a typical arrangement for coupling a shelf pivotally to a support member in accordance with the invention.

FIG. 3 is a partial sectional view along section 3—3 in FIG. 1, showing a typical arrangement for attaching a shelf 20 to a panel 30 in the present shelving system. As shown in FIG. 3, an end 32 of shelf 20 abuts panel 30 and a connecting member 34, such as a screw, penetrates through a bore 36 in panel 30 and into end 32 of shelf 20. Connecting member 34 has a central axis coincident with pivotal axis 24, so that shelf 20 may be pivoted about axis 24 while remaining supported by connecting member 34. Connecting member 34 may be moved (e.g. unscrewed) to a loosened position, without detaching shelf 20 from panel 30, to permit shelf 20 to be positioned angularly. Once shelf 20 has been positioned as desired, connecting member 34 may be tightened effectively to lock shelf 20 into the chosen position.

Figure 4:
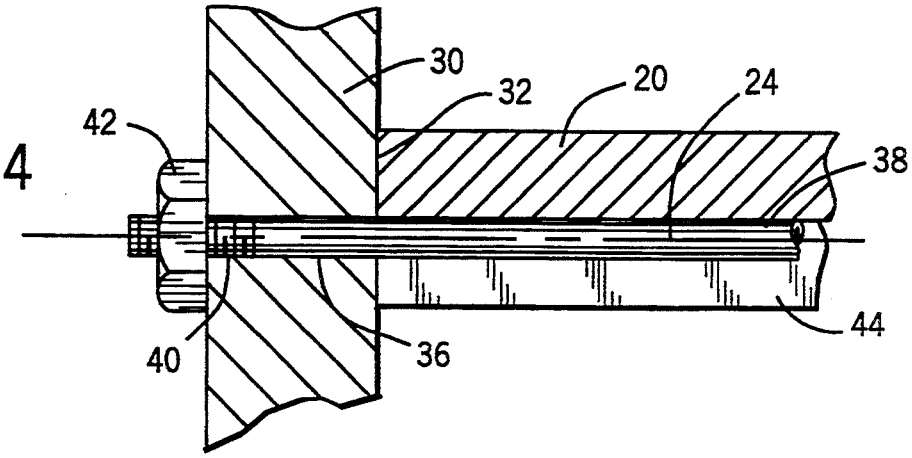
FIG. 4 is a partial sectional view along section 3—3 in FIG. 1 illustrating an alternative arrangement for coupling a shelf pivotally to a support member.

FIG. 4 shows, in partial section, an alternative arrangement for pivotally mounting the shelves to the support members. In this alternative arrangement, end 32 of shelf 20 abuts panel 30, and a rod 38, such as a small diameter steel rod, supports shelf 20. Rod 38 passes through bore 36 in panel 30 and includes a threaded end 40 that extends beyond panel 30. A threaded nut 42 is screwed onto end 40 to hold rod 38 in place. In this arrangement, nut 42 may be tightened to lock shelf 20 into any angular orientation, and loosened to permit pivotal movement of shelf 20 about axis 24. To facilitate positioning shelf 20 with respect to rod 38, a longitudinal groove 44 may be provided in shelf 20, such as by milling or routing.

Figure 5:
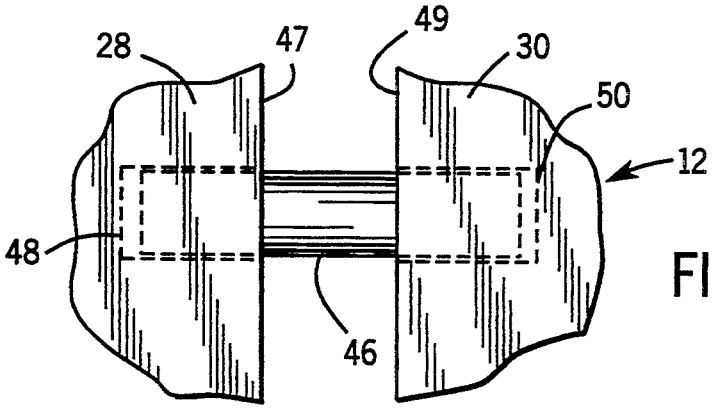
FIG. 5 is a detail view showing the manner in which similar panels may be connected to form the support members of the shelving system illustrated in FIG. 1.

FIG. 5 illustrates a preferred technique for joining two panels 28 and 30 to establish a support member 12. A typical panel 28 includes an edge 47 in which a bore 48 is formed. The mating panel 30 in support member 12 includes a similar edge 49 arranged in mutually facing relation with edge 47. Edge 49 has a bore 50 that lies in registration with bore 48 when panels 28 and 30 are assembled. A spacer 46, such as a hardwood dowel, is received and lodged (e.g. by gluing) in bores 48 and 50 to maintain the desired spacing between panels 28 and 30, thereby forming a unitary structure. In the present embodiment, each support member 12, 14 includes two such joints.

Figure 6:
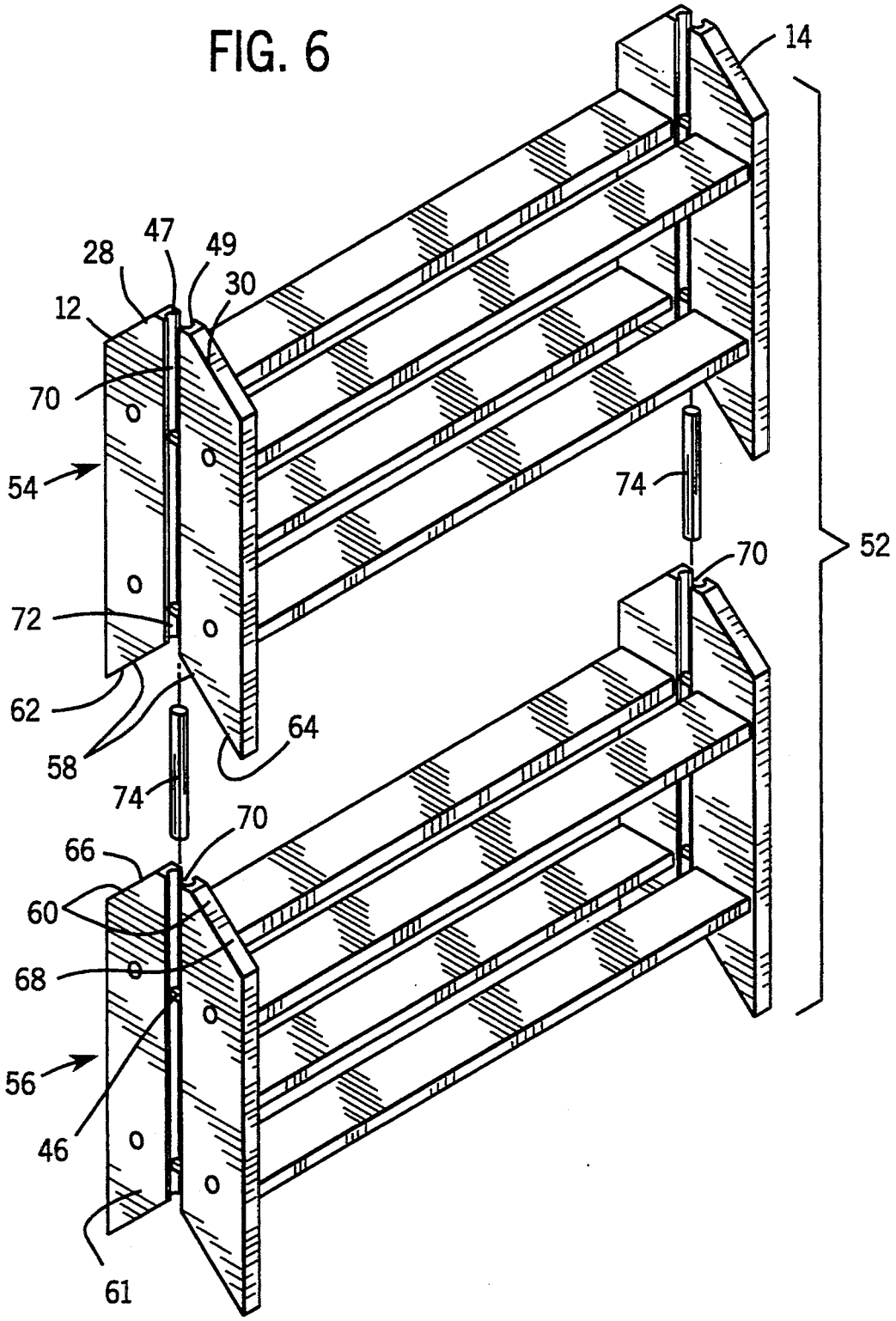
FIG. 6 is a top perspective exploded view of a shelving system including to modular shelving units of the type shown in FIG. 1.

As illustrated in FIG. 6, the present shelving arrangement is particularly suited to modular construction, such that an assembled shelving system 52 may be built by stacking two or more modular shelving units 54, 56 of the type described above. To facilitate stacking, each support member of modular shelving units 54 and 56 is provided with a lower stacking surface 58 (as shown on support member 12 in FIG. 6), and an upper stacking surface 60 (as shown on support member 61 in FIG. 6). To ensure alignment of upper shelving unit 54 atop lower shelving unit 56, each lower stacking surface 58 includes a first lower alignment portion 62 and a second lower alignment portion 64. In the presently preferred embodiment, alignment portions 62 and 64 are flat surfaces, inclined with respect to the horizontal and forming an oblique angle with respect to one another. Similarly, each upper stacking surface 60 includes a first upper alignment surface 66 and a second upper alignment surface 68, oriented to conform to lower alignment surfaces 62 and 64.

Figure 7:
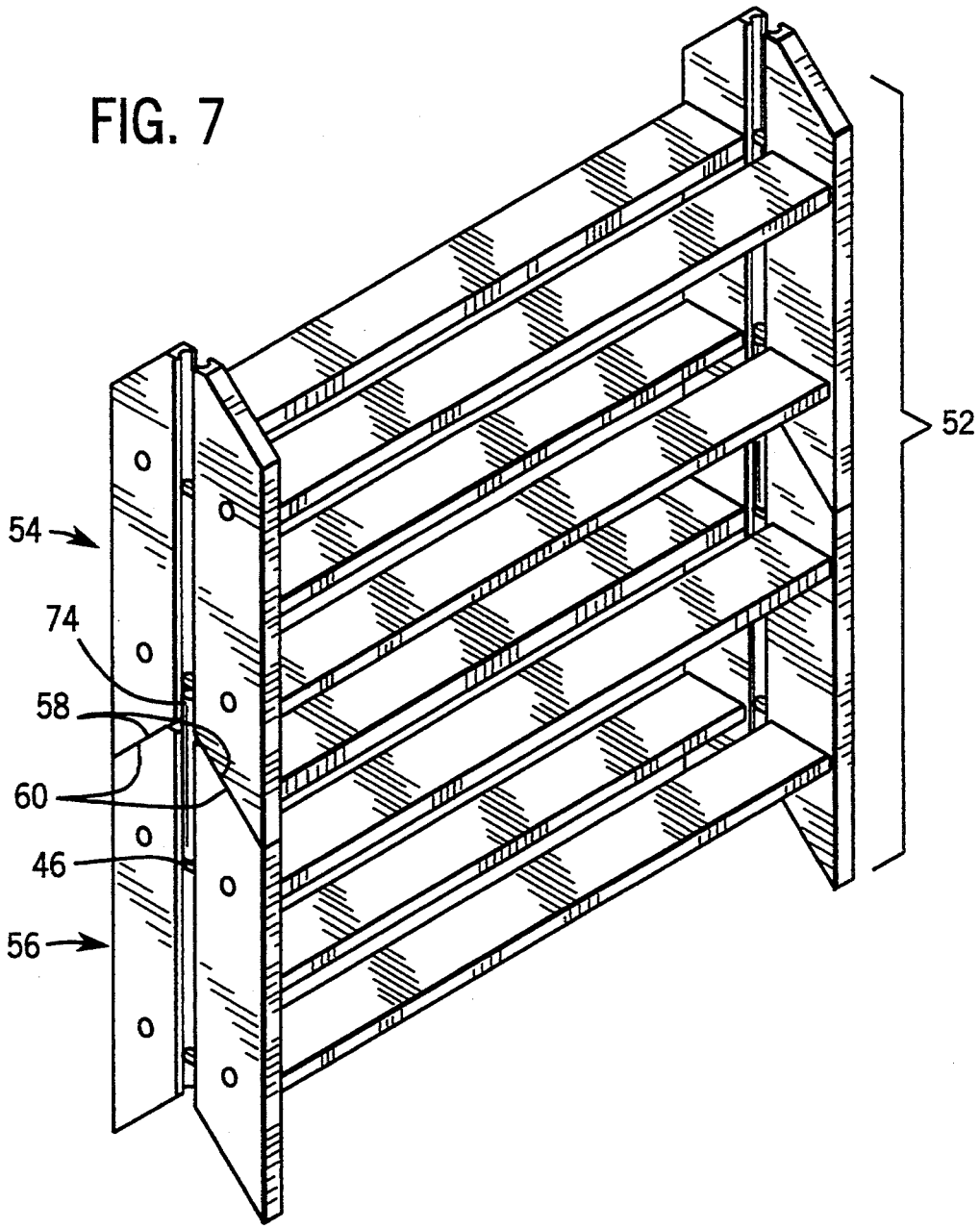
FIG. 7 is a top perspective view of the shelving system shown in FIG. 6 assembled into a stable unitary structure.

To maintain alignment of upper shelving unit 54 atop lower shelving unit 56, upper and lower alignment cavities 70 and 72 are formed in each support member 12 between panels 28 and 30. In the present embodiment, alignment cavities 70 and 72 are defined by concave grooves formed in the mutually facing edges 47 and 49 of each panel 28, 30. During assembly of shelving system 52, an alignment member 74, such as a wooden dowel, is positioned intermediate each mating pair of lower and upper stacking surfaces 58, 60 and is received in alignment cavities 70 and 72. As illustrated in FIG. 7, in the assembled shelving system 52, lower alignment surfaces 58 abut upper alignment surfaces 60 and alignment members 74 are positioned between upper shelving unit 54 and lower shelving unit 56. Spacer 46 is located at a convenient distance from upper stacking surface 60 to limit the downward travel of alignment member 74.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is intended to cover all modifications, equivalents and alternatives falling within the spirit and scope of the invention as defined by the appended claims.

I claim:

1. A shelving unit comprising:

a first support member extending in a first substantially vertical plane;

a second support member extending in a second plane, substantially parallel to the first plane;

a pair of shelves disposed intermediate the first and second support members, each of the shelves having a longitudinal pivot axis oriented substantially perpendicularly to the first and second planes, the pivot axes lying in a common plane; and a plurality of connecting members, a pair of the connecting members being associated with each of the shelves to pivotally connect the shelves to the support members, whereby each of the shelves is continuously positionable at any angular orientation about its respective pivot axis.

2. A shelving unit as recited in claim 1 wherein the first support member, the second support member, and the pair of shelves cooperate to establish a stable, self-supporting unit.

3. A shelving unit as recited in claim 1 further comprising a plurality of locking members, at least one of the locking members being associated with a respective shelf of the pair of shelves to selectively prevent pivotal movement of the respective shelf.

4. A shelving unit as recited in claim 1 wherein each of the connecting members includes a longitudinal axis coincident with the pivot axis of the associated shelf.

5. A shelving unit as recited in claim 1 wherein the connecting members are screws.

6. A shelving unit as recited in claim 1 wherein the common plane is substantially horizontal.

7. A shelving unit as recited in claim 1 wherein at least one of the pair of connecting members is selectively moveable between a tightened position and a loosened position, each of the associated shelves being prevented from pivotal movement when the connecting member is in the tightened position and permitted to pivot about its respective pivot axis when the connecting member is in the loosened position.

8. A shelving unit as recited in claim 1 further comprising a second pair of shelves mounted intermediate the first and the second support members, each shelf of the second pair of shelves having a longitudinal pivot axis oriented substantially perpendicularly to the first plane and the second plane, the pivot axes of the second pair of shelves lying in a second common plane, each shelf of the second pair of shelves being continuously pivotable about its respective pivot axis.

9. A modular shelving unit comprising:

a first support member extending in a first substantially vertical plane and having an upper end and a lower end;

a second support member extending in a second plane substantially parallel to the first plane and having an upper end and a lower end;

a pair of shelves disposed intermediate the first and second support members, each of the shelves having a longitudinal pivot axis oriented substantially perpendicularly to the first and second planes, the pivot axes lying in a common substantially horizontal plane; and a plurality of connecting members, a pair of the connecting members being associated with each of the shelves to pivotally connect the shelves to the support members, whereby each of the shelves is continuously positionable at any angular orientation about its respective pivot axis;

wherein each of the upper ends of the first and second support members includes an upper stacking surface adapted to conformingly engage a lower stacking surface of a similar first modular shelving unit disposed atop the shelving unit, and each of the lower ends of the first and second support members includes a lower stacking surface adapted to conformingly engage an upper stacking surface of a second similar modular shelving unit disposed below the shelving unit.

10. A modular shelving unit as recited in claim 9 further comprising a plurality of locking members, wherein at least one of the locking members is associated with a respective shelf of the pair of shelves to selectively prevent pivotal movement of the respective shelf.

11. A modular shelving unit as recited in claim 9 wherein each of the connecting members includes a longitudinal axis coincident with the pivot axis of an associated shelf.

12. A modular shelving unit as recited in claim 9 wherein each of the upper stacking surfaces includes a first upper alignment portion and a second upper alignment portion, and each of the lower stacking surfaces includes a first lower alignment portion and a second lower alignment portion, the first lower alignment portion being adapted to cooperate with a first upper alignment portion of a similar modular shelving unit, and the second lower alignment portion being adapted to cooperate with a second upper alignment portion of a similar modular shelving unit.

13. A modular shelving unit as recited in claim 12 wherein the first upper alignment portion is obliquely oriented with respect to the second upper alignment portion, and the first lower alignment portion is obliquely oriented with respect to the second lower alignment portion.

14. A modular shelving system comprising:

a lower modular shelving unit and an upper modular shelving unit disposed atop the lower modular shelving unit, each of the modular shelving units including:

a first support member extending in a first substantially vertical plane and having an upper end and a lower end;

a second support member extending in a second plane substantially parallel to the first plane and having an upper end and a lower end;

a pair of shelves disposed intermediate the first and the second support members, each of the shelves having a longitudinal pivot axis oriented substantially perpendicularly to the first and second planes, the pivot axes lying in a common substantially horizontal plane; and a plurality of connecting members, a pair of the connecting members being associated with each of the shelves to mount the shelves pivotally on the support members, whereby each of the shelves is continuously pivotable about its respective pivot axis;

wherein each of the upper ends of the first and second support members of the lower modular shelving unit includes an upper stacking surface, each of the lower ends of the first and second support members of the upper modular shelving unit includes a lower stacking surface, and each of the upper stacking surfaces conformingly engages a respective lower stacking surface of the first and second support members of the upper modular shelving unit.

15. A modular shelving system as recited in claim 14 wherein each of the first and second support members of the lower modular shelving unit includes a substantially vertical, upwardly opening alignment cavity formed in the upper end thereof, and each of the first and second support members of the upper modular shelving unit includes a substantially vertical, downwardly opening alignment cavity formed in the lower end thereof, each of the upwardly opening alignment cavities of the first and second support members of the lower modular shelving unit being positioned in mutually facing relation with a respective downwardly opening alignment cavity of the first and second support members of the upper modular shelving unit; and wherein the shelving system further comprises a pair of alignment members received in the mutually facing alignment cavities to maintain alignment of the upper modular shelving unit atop the lower modular shelving unit.

16. A modular shelving system as recited in claim 15 wherein each of the first support members and each of the second support members comprises a pair of panels, each of the panels having a side face, the panels being joined with the faces in mutually facing, spaced apart position by at least one spacer, the spacer cooperating with the faces to define the alignment cavities.

17. A modular shelving system as recited in claim 14 wherein each of the first support members and each of the second support members comprises a pair of panels, each of the panels being substantially identical to every other panel in the modular shelving system,

18. A modular shelving system as recited in claim 14 further comprising a plurality of locking members, wherein at least one of the locking members is associated with a respective shelf of the pair of shelves to selectively prevent pivotal movement of the shelf.

19. A modular shelving system as recited in claim 14 wherein at least one of the pair of connecting members associated with each of the shelves is selectively moveable between a tightened position and a loosened position, each of the shelves being prevented from pivotal movement when the connecting member is in the tightened position and permitted to pivot about its respective pivot axis when the connecting member is in the, loosened position.

20. A modular shelving system as recited in claim 14 wherein each of the upper stacking surfaces of the lower modular shelving unit includes a first upper alignment portion and a second upper alignment portion, and each of the lower stacking surfaces of the upper modular shelving unit includes a first lower alignment portion and a second lower alignment portion, each of the first lower alignment portions cooperating with a respective one of the first upper alignment portions and each of the second lower alignment portions cooperating with a respective one of the second upper alignment portions to maintain alignment of the upper modular shelving unit atop the lower modular shelving unit.

* * * * *